United States Patent [19]

Ligouri

[11] 4,302,120

[45] Nov. 24, 1981

[54] NIB ASSEMBLY

[75] Inventor: Thomas A. Ligouri, Poway, Calif.

[73] Assignee: L.C.R.D. Corp., San Diego, Calif.

[21] Appl. No.: 107,575

[22] Filed: Dec. 27, 1979

[51] Int. Cl.[3] ..... B43K 1/12; B43K 5/16

[52] U.S. Cl. ..... 401/198; 401/207

[58] Field of Search ..... 401/196-207

[56] References Cited

U.S. PATENT DOCUMENTS 2,458,027 1/1949 Quist ..... 401/205
2,530,234 11/1950 Duncan ..... 401/198

FOREIGN PATENT DOCUMENTS 2016401 10/1971 Fed. Rep. of Germany ..... 401/199
2905839 10/1979 Fed. Rep. of Germany ..... 401/199
1439018 4/1966 France ..... 401/196
422577 4/1967 Switzerland ..... 401/196

*Primary Examiner*—Clyde I. Coughenour
*Attorney, Agent, or Firm*—Richard H. Zaitlen

[57] ABSTRACT

This invention relates to marking instruments having a uniquely configured nib assembly. The nib assembly comprises an elongated nib, a tip adapter having a first bore and second bore formed therein, the first bore open to the proximal end of the adapter and the second bore open to the distal end of the adapter. A sleeve extends into the first bore and is retained therein. The sleeve has an opening formed along the length thereof with the nib extending through the opening and beyond the distal end of the adapter. The opening and the second bore of the adapter are configured such that the nib is prevented from being pushed back up into the assembly.

3 Claims, 5 Drawing Figures

NIB ASSEMBLY

BACKGROUND OF THE INVENTION

1. Field of the Invention

The present invention relates to the field of marking instruments and more specifically, to a nib assembly for use in such marking instruments.

2. Prior Art

The prior art is well aware of many marking devices and instruments in which a writing nib member extends outwardly from a generally cylindrical reservoir which contains ink or other marking fluid. Examples of such devices are set forth in U.S. Pat. Nos. 2,453,201; 3,153,804; 3,153,804; and 3,377,124. Each of these references, however, is directed to a device which either has a complex valve system and/or does not securely position the nib member therein. One problem with a poorly secured nib member is that should the user press down hard against a surface, there is a tendency for the nib to be pushed back up into the carrier in which it is being retained. Once this should happen, the writing device would be substantially ruined and would have to be discarded. Those devices which more securely retain the writing nib in position, generally also contain a complex valving system which substantially increases the cost. Thus, there has existed a long felt need for a writing instrument which has a nib member securely retained in position, such that pressing the nib against a surface does not cause the nib to be driven back up into the carrier, and without the resort to complex mounting systems and/or valve configuration. The present invention is a solution to these and other problems.

BRIEF SUMMARY OF THE INVENTION

The present invention relates to writing instruments, and more specifically, to a uniquely configured nib assembly for use in such instruments. The nib assembly of the present invention comprises a generally cylindrical elongated nib member which is made of a material such that it can direct ink or other marking fluid onto a variety of writing surfaces. The nib member is securely positioned in a tip adapter having a first and second bore formed therein. The first bore is open to the proximal end of the adapter and the second bore is open to the distal end of the adapter. The nib extends through the first and second bores beyond the distal end of the adapter. A sleeve member circumferentially surrounds the nib and is retained in the first bore. The sleeve has an eccentric opening along the length thereof through which the nib extends. This eccentric opening and the second bore of the adapter are arranged and configured such that one portion of the nib abuts against one end of the sleeve while another portion abuts against a ledge formed in the tip adapter. In this manner, axial movement of the nib in the assembly is prevented.

The novel features which are believed to be characteristic of the invention, both as to its organization and methods of operation, together with further objectives and advantages thereof will be better understood from the following description considered in connection with the accompanying drawings in which a presently preferred embodiment of the invention is illustrated by way of example. It is to be expressly understood, however, that the drawings are for purposes of illustration and description only, and are not intended as a definition of the limits of the invention.

DETAILED DESCRIPTION OF THE INVENTION

Figure 3:
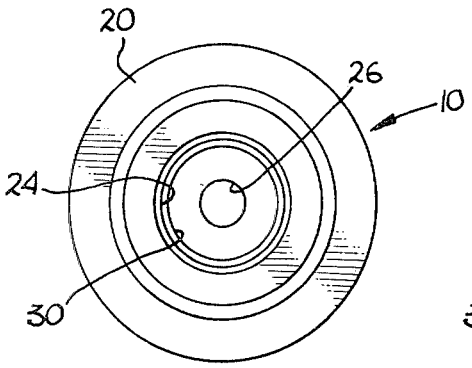
FIG. 3 is a top plan view of the tip adapter showing the internally formed bores.
Figure 2:
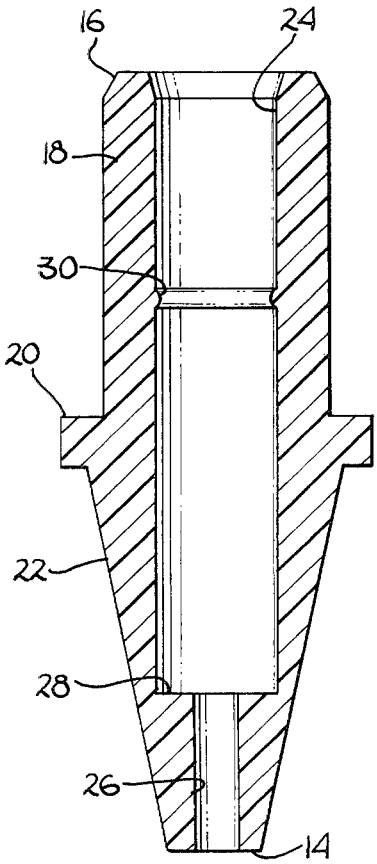
FIG. 2 is a cut-away view of a tip adapter section of the nib assembly.
Figure 4:
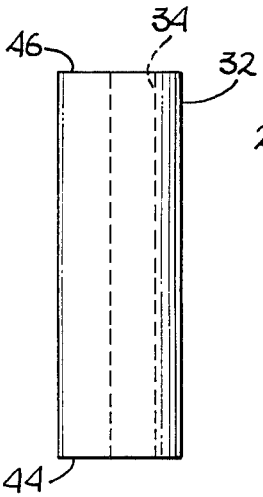
FIG. 4 is a cut-away view showing a sleeve section of the nib assembly.
Figure 1:
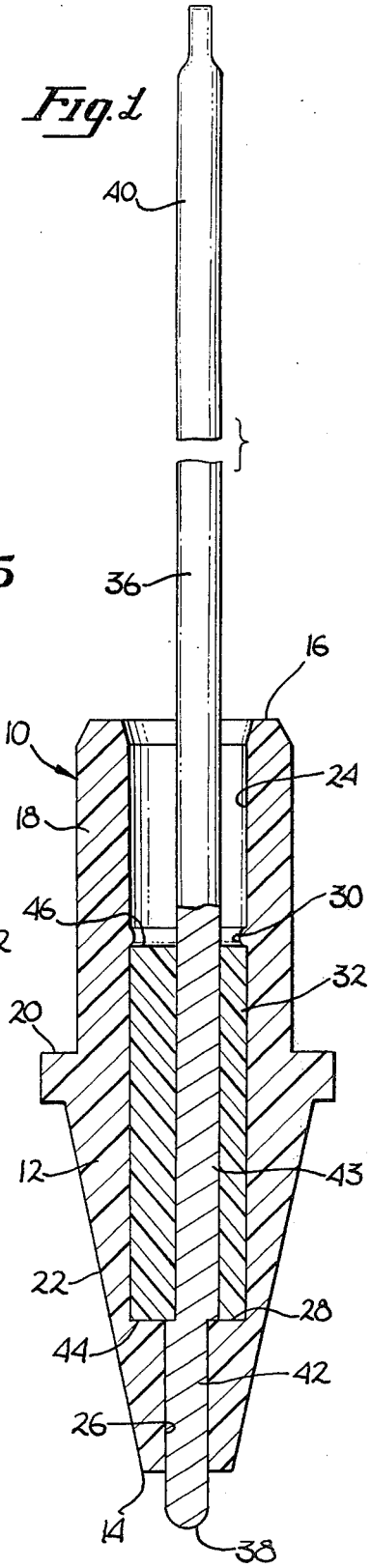
FIG. 1 is a cut-away view of the nib assembly of the present invention.

Referring first to FIG. 1, there is shown, as the presently preferred embodiment, the nib assembly 10. Nib assembly 10 is comprised of a tip adapter 12, also shown with reference to FIGS. 2 and 3, having a distal end 14 and a proximal end 16. The tip adapter 12 has a generally cylindrical section 18, a V-shaped 22, and a generally circular ledge 20 formed thereinbetween. A first bore 24 extends axially through the cylindrical section 18 while a second, and smaller diameter bore 26 extends axially through the V-shaped section 22. The first and second bores, 24 and 26, form a ledge 28 thereinbetween. In addition, an inwardly extending retaining ring 30 is also formed along the length of first bore 24 which retains a cylindrical sleeve 32 in the adapter 12 as hereinbelow described in greater detail.

Figure 5:
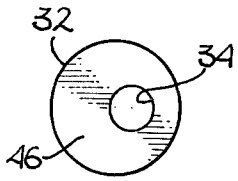
FIG. 5 is a top plan view of the sleeve showing the eccentric opening which extends therethrough.

Sleeve 32, which may be made of metal or other similar material, has a cylindrical opening 34 formed therein along the length thereof. Opening 34 is eccentrically located in sleeve 32, that is, the axis of opening 34 and the axis of tubular sleeve 32 are not the same. Thus, opening 34 is not located at the center of sleeve 32 with respect to its longitudinal axis. This is perhaps best illustrated in FIG. 5.

Referring again to FIG. 1, one can see that a nib member 36 is inserted into the nib assembly 10 so as to protrude beyond the distal end 14 of the adapter 12. In this manner, the writing end 38 of nib 36 can readily engage any surface upon which the user desires to write. The other end 40 of nib 36 extends up into an ink reservoir in an associated writing instrument such as is well known in the art. Nib 36 is made of a material such that ink or other marking fluid readily flows from one end 40 of the nib 36 to the writing end 38 thereof.

As discussed herein above, one of the problems with the prior art writing instruments was that the writing nib or equivalent could be pushed back into the carrier when the writing end was pressed against a surface. In the present invention, this problem is obviated by causing the nib 36 to form a first section 42 and a second section 43. This offset configuration is created by the eccentric opening 34 in sleeve 32. More specifically, referring to FIG. 1 one can see that the nib 36 is required to take a substantial right angle bend in order to proceed both through the sleeve 32 and the second bore 26. This bend is caused because part of the distal end 44 of sleeve 32 covers part of the opening of bore 26. Thus, for nib 36 to pass through both sleeve 32 and bore 26, it is shifted, i.e., offset along its longitudinal axis. This offset configuration also helps insure that there is at least partial contact between sleeve 32 and nib 36 irrespective of the diameter of nib 36.

In terms of assembly, the writing nib 36 is inserted into the tip adapter 12 such that the writing end 38 extends beyond the distal end 14 thereof. The sleeve 32 is then slipped over the nib 36 such that nib 36 extends through opening 34. Preferably, the diameter of opening 34 and of nib 36 are selected such that contact by and between these elements is maintained. Further, the diameter of bore 26 and nib 36 is also selected to maintain contact between these elements as well. The sleeve 32 is then pushed into the first bore 24 of the tip adapter 12. When the sleeve 32 initially contacts the retaining ring 30, the retaining ring 30 flexes sufficiently so as to let the sleeve 32 pass across it. Once the proximal end 46 of sleeve 32 has passed beyond the retaining ring 30, the ring 30 snaps back so as to extend partly across the distal end 46. In this member, sleeve 32 is retained in a predetermined position in the first bore 24 of the tip adapter 12. Other means for retaining sleeve 32 in adapter 12 are within the scope of the present invention. To insure that sleeve 32 does not rotate or otherwise move in bore 24, an ultra-sonic welding horn (not shown) may be slipped over nib 36 so as to engage end 46 of sleeve 32. Application of ultra-sonic waves causes sleeve 30, at its proximal end 44, to be bonded to the tip adapter 12 at ledge 28. Bonding by and between the nib 36 and sleeve 32 is also achieved, and this bonding is encouraged by the offset configuration of nib 36, which insures the contact between the nib and sleeve 32 which is necessary for the ultrasonic welding. It is to be understood that other means for retaining sleeve 32 in tip adapter 12, and for bonding elements 12, 32 and 36 together are within the scope of the present invention.

When in place, sleeve 32 causes the nib 36 to be offset in the area adjacent ledge 28. In this manner, pressure on writing tip 38 is transferred to end 44 of sleeve 32 or to ledge 28 of adapter 12. This configuration thus substantially precludes axial movement of the nib 36 in the sleeve 32, as well as in the tip adapter 12.

It should be understood that while the preferred example described herein deals with cylindrical shapes, other configurations can be used using the same principles. Further, the various elements can be made from a wide range of material including metal and plastic. Thus, it is apparent to one skilled in the art, that changes and modifications can be made to this invention without departing from the spirit and scope thereof as defined and claimed herein.

I claim:

1. A nib assembly for use in a marking instrument, comprising:

an elongated nib;

a tip adapter having a first bore and a second bore formed therein, said first bore open to the proximal end of said adapter and said second bore open to the distal end of said adapter wherein the diameter of said first bore is larger than the diameter of said second bore thereby forming an abutment at the point where said first bore intersects said second bore;

a sleeve disposed within said first bore, having a flat end portion, said end portion being perpendicular to the axis of said sleeve, said sleeve having an opening longitudinally therethrough, said opening being eccentric with respect to the axis of said sleeve; and means for retaining said sleeve in said first bore such that said end portion of said sleeve is in contact with said abutment;

wherein said nib extends through said second bore and through said opening in said sleeve such that said nib is caused to bend radially at the point where it extends from said second bore to said opening in said sleeve and a portion of said nib is caused to abut said end portion of said sleeve, thereby preventing said nib from being pushed up into said marking instrument.

2. The assembly of claim 1 wherein said sleeve, nib and tip adapter are bonded together by ultra-sonic welding.

3. A method for securing a nib in a marking instrument, comprising:

inserting an elongated nib through a tip adapter having a first bore and a second bore formed therein wherein the writing point of said nib is adjacent said second bore and further wherein the diameter of said first bore is larger than the diameter of said second bore, thereby forming an abutment at the point where said first bore intersects said second bore;

inserting a sleeve with a flat end portion, said end portion being perpendicular to the axis of said sleeve, into said first bore wherein said sleeve has an opening therethrough configured to receive said nib and further wherein said opening is eccentric with respect to the axis of said sleeve, said nib passing through said opening, and urging said sleeve into said first bore and along said nib until said end portion of said sleeve abuts against said abutment, thereby causing said nib to be bent radially between said second bore and said opening such that a portion of said nib abuts the end portion of said sleeve, thereby preventing longitudinal movement of said nib; and bonding said sleeve, nib and tip adapter together by ultra-sonic welding.

* * * * *